US010132599B2

(12) United States Patent
Trimbath

(10) Patent No.: US 10,132,599 B2
(45) Date of Patent: Nov. 20, 2018

(54) INTEGRATED SHOOTING TARGET SUPPORT POST DRIVING SYSTEM

(71) Applicant: Steel Ops Ltd., Fort Collins, CO (US)

(72) Inventor: Joseph Scott Trimbath, Fort Collins, CO (US)

(73) Assignee: Steel Ops Ltd., Fort Collins, CO (US)

( * ) Notice: Subject to any disclaimer, the term of this patent is extended or adjusted under 35 U.S.C. 154(b) by 68 days.

(21) Appl. No.: 14/645,365

(22) Filed: Mar. 11, 2015

(65) Prior Publication Data

US 2015/0260486 A1 Sep. 17, 2015

Related U.S. Application Data

(60) Provisional application No. 61/952,514, filed on Mar. 13, 2014.

(51) Int. Cl.
*F41J 1/10* (2006.01)
*F41J 7/04* (2006.01)

(52) U.S. Cl.
CPC .. *F41J 1/10* (2013.01); *F41J 7/04* (2013.01)

(58) Field of Classification Search
CPC ..... E01F 9/011; G09F 21/04; G09F 21/00; G09F 7/18; F41J 7/04
USPC ..... 273/407, 391; 40/607.06
See application file for complete search history.

(56) References Cited

U.S. PATENT DOCUMENTS 4,219,179 A * 8/1980 Silbernagel ..... G09F 7/18 248/159
4,524,533 A * 6/1985 Still, Jr. ..... G09F 7/18 248/156
4,773,652 A * 9/1988 Mosser ..... F41J 7/04 273/392
6,896,267 B1 * 5/2005 Le Anna ..... F41J 7/04 273/391

OTHER PUBLICATIONS

U.S. Appl. No. 61/658,324, filed Jun. 11, 2012.

* cited by examiner

*Primary Examiner* — Gene Kim
*Assistant Examiner* — Christopher Glenn
(74) *Attorney, Agent, or Firm* — Craig R. Miles; CR Miles P.C.

(57) ABSTRACT

A target assembly having a target body and a drive element coupled to the target body, whereby the drive element can be configured for impacting an upper portion of a support element to impactingly drive a lower portion of the support element into a support surface.

15 Claims, 7 Drawing Sheets

32/33/34/41
1
50
59
51
5
26/39
9B
6/12
43
4
42
6
11
12
44/45
27
4/42
28
29
26
44
45
46
40
48
47
49

INTEGRATED SHOOTING TARGET SUPPORT POST DRIVING SYSTEM

This United States Non-Provisional Patent Application claims the benefit of U.S. Provisional Patent Application No. 61/952,514, filed Mar. 13, 2014, hereby incorporated by reference herein.

I. SUMMARY OF THE INVENTION

A broad object of a particular embodiment of the invention can be to provide a target assembly having a target body and a drive element coupled to the target body, whereby the drive element can be configured for impacting an upper portion of a support element to impactingly drive a lower portion of the support element into a support surface.

Another broad object of a particular embodiment of the invention can be to provide a method of making a target assembly (1), the method including providing a target body, and coupling a drive element to the target body, whereby the drive element can be configured for impacting an upper portion of a support element to impactingly drive a lower portion of the support element into a support surface.

Another broad object of a particular embodiment of the invention can be to provide a method of using a target assembly, the method including obtaining the target assembly having a target body and a drive element coupled to the target body, whereby the drive element can be configured for impacting an upper portion of a support element to impactingly drive a lower portion of the support element into a support surface; and engaging the upper portion of the support element with the drive element to impactingly drive the lower portion of the support element a depth into the support surface.

Another broad object of a particular embodiment of the invention can be to provide a method of using a target assembly, the method further including removably engaging the target body with the upper portion of the support element to provide a shooting target.

Naturally, further objects of the invention are disclosed throughout other areas of the specification, drawings, and claims.

II. BRIEF DESCRIPTION OF THE DRAWINGS

III. DETAILED DESCRIPTION OF THE INVENTION

Figure 1A:
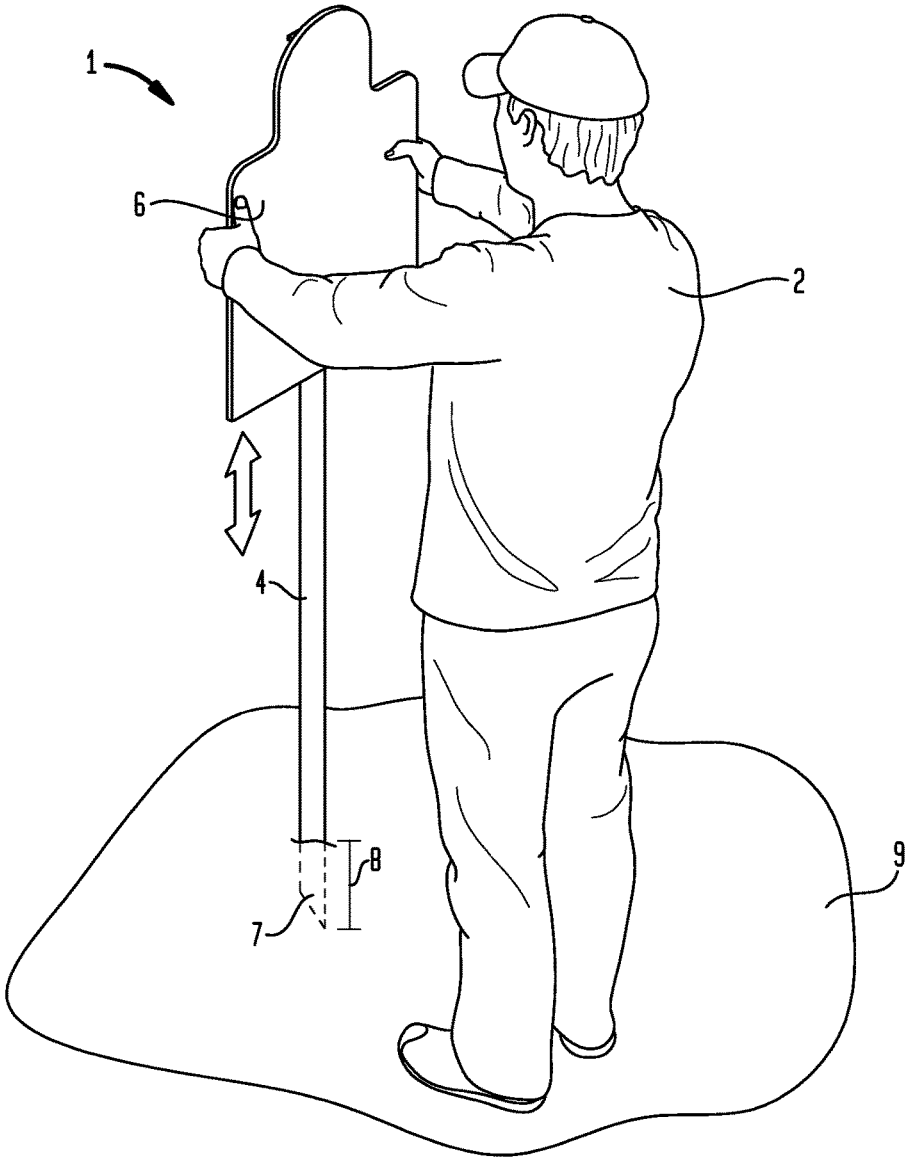
FIG. 1A is an illustration of a method of using a particular embodiment of a target assembly, whereby a drive element coupled to a target body can be used to impact an upper portion of a support element to drive a lower portion of the support element a depth into a support surface.
Figure 1B:
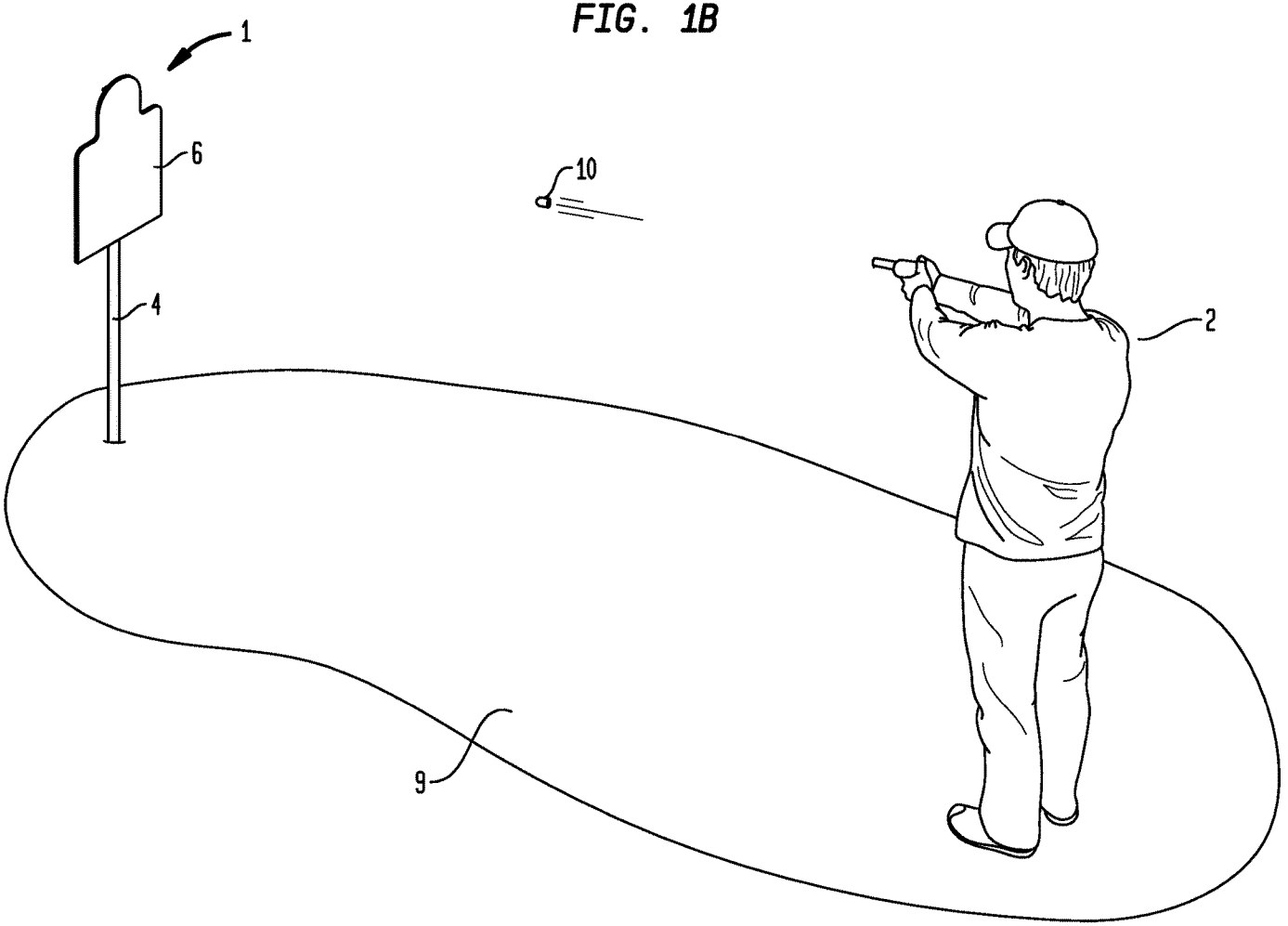
FIG. 1B is an illustration of a method of using a particular embodiment of a target assembly, whereby a target body can be removably engaged with an upper portion of a support element for use as a shooting target.

Now referring primarily to FIG. 1A and FIG. 1B, which illustrate methods of using a particular embodiment of a target assembly (1). A user (2) can engage an upper portion (3) of a support element (4) with a drive element (5) coupled to a target body (6). The user (2) can generate reciprocal movement of the target body (6) to correspondingly generate reciprocal movement of the drive element (5) engaged with the upper portion (3) of the support element (4). The drive element (5) can impact the upper portion (3) of the support element (4) to drive a lower portion (7) of the support element (4) a depth (8) into a support surface (9). The lower portion (7) of the support element (4) can be driven into the support surface (9) a depth (8) sufficient to support the target assembly (1) in a desired position. The target body (6) can then be removably engaged with the upper portion (3) of the support element (4) for use as a shooting target. The user (2) can launch a projectile (10) toward the shooting target from a location remote from the target assembly (1).

Figure 2:
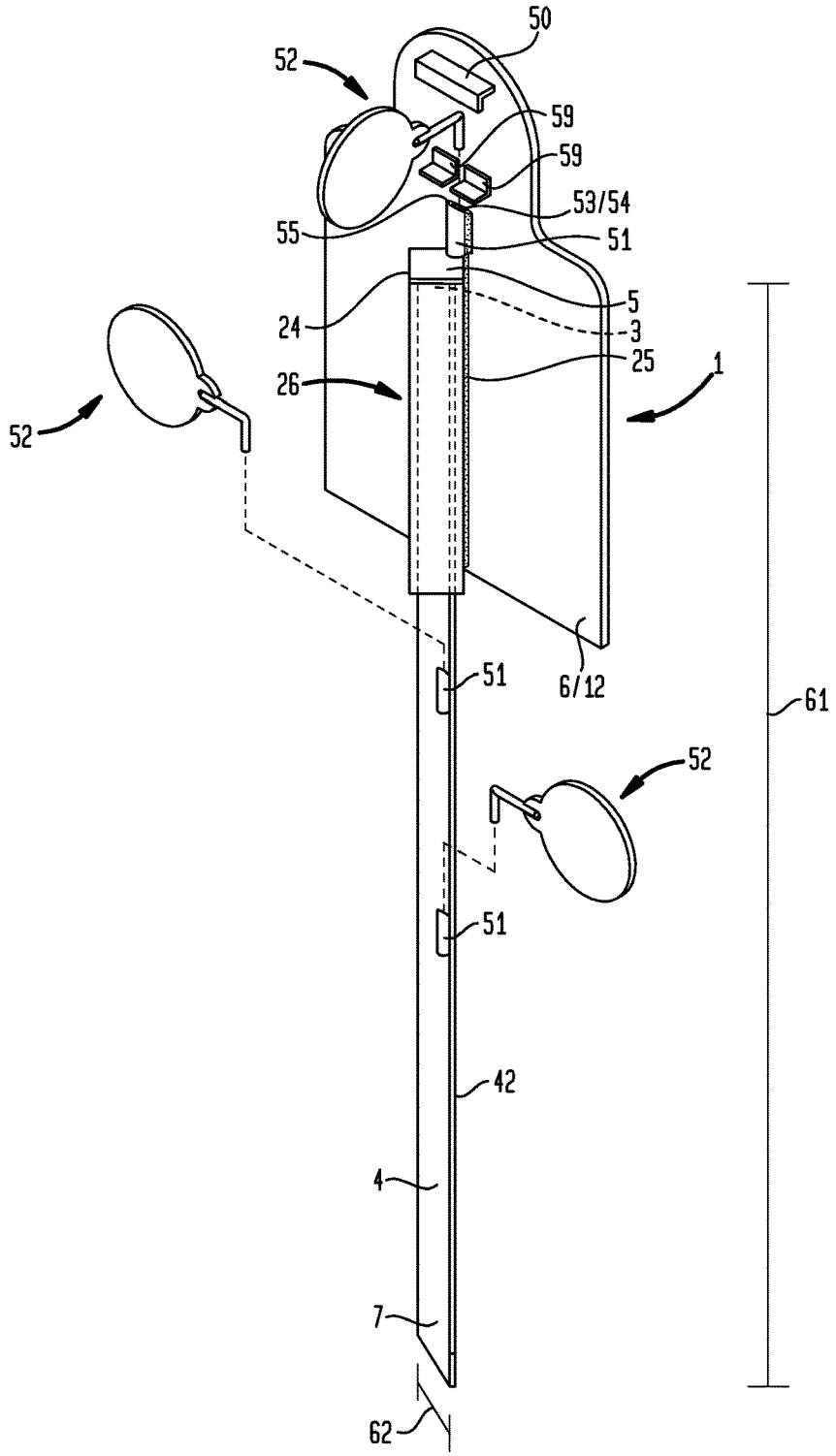
FIG. 2 is a perspective view of a particular embodiment of a target assembly.
Figure 4:
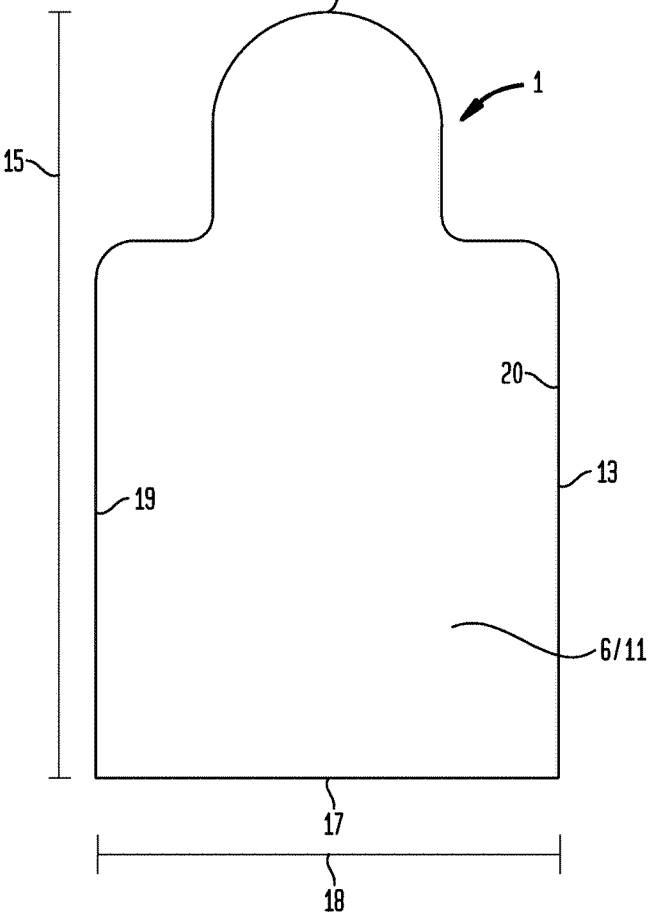
FIG. 4 is a first face view of a target body of a particular embodiment of a target assembly.
Figure 3:
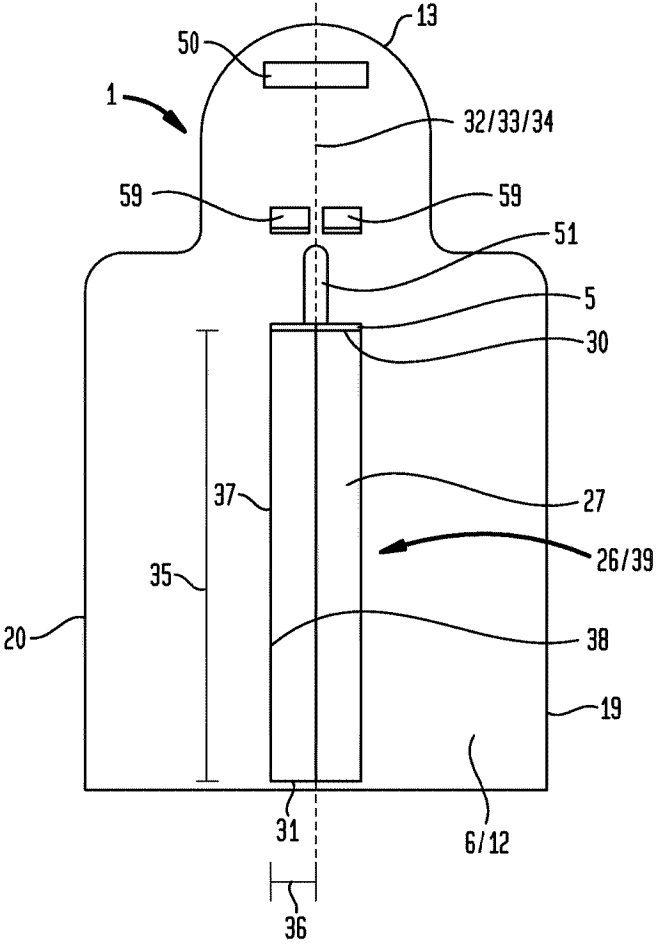
FIG. 3 is a second face view of a target body of a particular embodiment of a target assembly.
Figure 8:
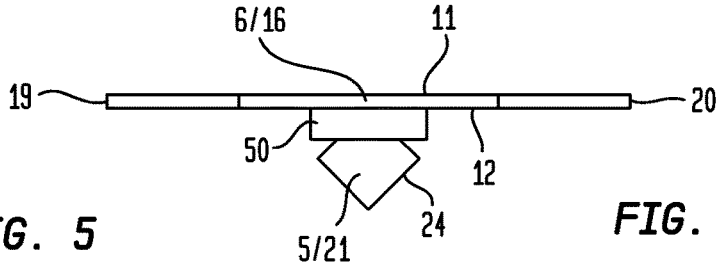
FIG. 8 is a top view of a target body of a particular embodiment of a target assembly.

Now referring primarily to FIG. 2 through FIG. 4, a target assembly (1) can include a target body (6) and a drive element (5) coupled to the target body (6). The drive element (5) can be configured to impact an upper portion (3) of a support element (4) to impactingly drive a lower portion (7) of the support element (4) into a support surface (9).

The target body (6) can be formed from any material suitable to receive a projectile (10) launched by a user (2). Examples of materials suitable for use with particular embodiments of the target body (6) can include metal, wood, plastic, plastic-like materials, paper, paper-like materials, or the like, or combinations thereof. As an illustrative example, the target body (6) can be formed from steel.

Now referring primarily to FIG. 3 and FIG. 4, the target body (6) can include opposing target body first and second faces (11)(12) extending to a target body periphery (13). As to particular embodiments, the target body first and second faces (11)(12) can be substantially planar, as shown in the examples of the Figures. However, the invention need not be so limited and, as to other particular embodiments, the target body first and second faces (11)(12) can be non-planar. As an illustrative example of these particular embodiments, the target body (6) can have arcuate target body first and second faces (11)(12).

The target body periphery (13) can define numerous configurations of varying dimensions. While the illustrative example of the target body periphery (13) shown in the Figures defines a configuration which substantially depicts a head (semi-oval portion) and an upper body (substantially rectangular portion) of a person, particular embodiments can have a target body periphery (13) which defines any suitable configuration, including or consisting of: a circle, an oval, a triangle, a square, a rectangle, a trapezoid, a polygon, a freeform shape, or the like, or combinations thereof. In addition, particular embodiments can have a target body periphery (13) which defines an image, for example a human image, an animal image, a fanciful creature image, or the like, or combinations thereof.

Figure 5:
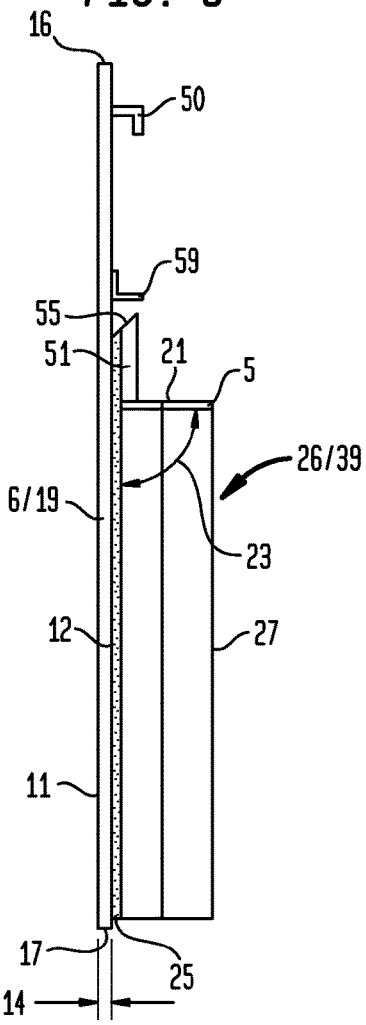
FIG. 5 is a first side view of a target body of a particular embodiment of a target assembly.
Figure 6:
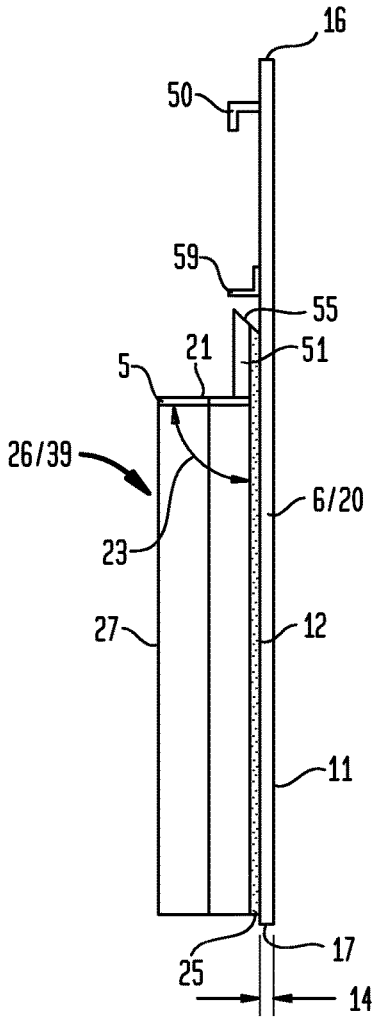
FIG. 6 is a second side view of a target body of a particular embodiment of a target assembly.
Figure 7:
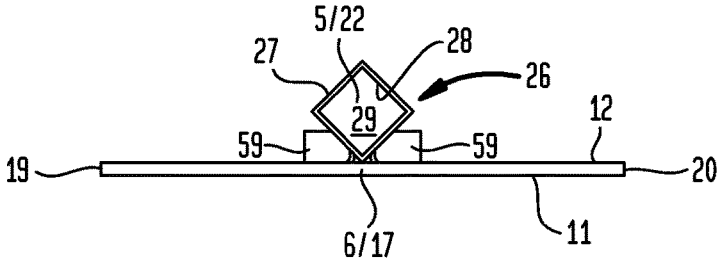
FIG. 7 is a bottom view of a target body of a particular embodiment of a target assembly.

Now referring primarily to FIG. 5 and FIG. 6, the target body (6) can have a target body thickness (14) disposed between the target body first and second faces (11)(12). Typically, the target body thickness (14) can be in a range of between about ⅛ inch to about 6 inches; however, particular embodiments can have lesser or greater target body thicknesses (14), depending upon the application. As to particular embodiments, the target body thickness (14) can be selected from the group including or consisting of: between about ⅛ inch to about 1 inch, between about 0.5 inches to about 1.5 inches, between about 1 inch to about 2 inches, between about 1.5 inches to about 2.5 inches, between about 2 inches to about 3 inches, between about 2.5 inches to about 3.5 inches, between about 3 inches to about 4 inches, between about 3.5 inches to about 4.5 inches, between about 4 inches to about 5 inches, between about 4.5 inches to about 5.5 inches, and between about 5 inches to about 6 inches. As an illustrative example, the target body (6) can have a target body thickness (14) of about ¼ inch.

Now referring primarily to FIG. 4, the target body (6) can have a target body length (15) disposed between target body top and bottom ends (16)(17). Typically, the target body length (15) can be in a range of between about 6 inches to about 72 inches; however, particular embodiments can have lesser or greater target body lengths (15), depending upon the application. As to particular embodiments, the target body length (15) can be selected from the group including or consisting of: between about 6 inches to about 18 inches, between about 12 inches to about 24 inches, between about 18 inches to about 30 inches, between about 24 inches to about 36 inches, between about 30 inches to about 42 inches, between about 36 inches to about 48 inches, between about 42 inches to about 54 inches, between about 48 inches to about 60 inches, between about 54 inches to about 66 inches, and between about 60 inches to about 72 inches.

Again referring primarily to FIG. 4, the target body (6) can have a target body width (18) disposed between target body first and second sides (19)(20). Typically, the target body width (18) can be in a range of between about 6 inches to about 72 inches; however, particular embodiments can have lesser or greater target body widths (18), depending upon the application. As to particular embodiments, the target body width (18) can be selected from the group including or consisting of: between about 6 inches to about 18 inches, between about 12 inches to about 24 inches, between about 18 inches to about 30 inches, between about 24 inches to about 36 inches, between about 30 inches to about 42 inches, between about 36 inches to about 48 inches, between about 42 inches to about 54 inches, between about 48 inches to about 60 inches, between about 54 inches to about 66 inches, and between about 60 inches to about 72 inches.

As an illustrative example, a target body (6) can have a target body periphery (13) defining a semi-oval portion coupled to a substantially rectangular portion, whereby the target body length (15) can be about 27 inches and the target body width (18) can include a semi-oval portion width of about 9 inches and a substantially rectangular portion width of about 18 inches.

Now referring primarily to FIG. 2, FIG. 3, FIG. 5, FIG. 6, and FIG. 8, the drive element (5), which can include opposing drive element first and second faces (21)(22), can outwardly extend from the target body second face (12). As to particular embodiments, outward extension of the drive element (5) from the target body second face (12) can dispose the drive element second face (22) in angled relation to the target body second face (12). As to particular embodiments, the angled relation can include a drive element second face angle (23) in a range of between about 60 degrees to about 120 degrees. As an illustrative example, the drive element second face angle (23) can be about 90 degrees, disposing the drive element (5) in substantially perpendicular relation to the target body second face (12).

Again referring primarily to FIG. 2, FIG. 3, FIG. 5, FIG. 6, and FIG. 8, the drive element (5), including a drive element periphery (24), can have any of a numerous and wide variety of configurations suitable for impacting the upper portion (3) of the support element (4), thereby transferring a sufficient amount of force to the support element (4) to impactingly drive the lower portion (7) of the support element (4) a depth (8) into the support surface (9).

While the illustrative example of the drive element periphery (24) shown in the Figures defines a substantially square drive element periphery (24), particular embodiments of the drive element (5) can have a drive element periphery (24) which defines any suitable configuration, including or consisting of: a circle, an oval, a triangle, a square, a rectangle, a trapezoid, a polygon, a freeform shape, or the like, or combinations thereof.

The drive element (5) can be fixedly or removably coupled to the target body second face (12) by any of a wide variety of coupling materials including: welds, adherents, mechanical fasteners, cements, crimps, glues, seals, tapes, or the like, or combinations thereof. As an illustrative example, a drive element (5) formed from metal can be fixedly coupled to a target body second face (12) formed from metal by welds (25) (as shown in the Figures by a stippled layer).

Now referring primarily to FIG. 3, and FIG. 5 through FIG. 8, particular embodiments of the target assembly (1) can, but need not necessarily, further include a tubular member (26) coupled to the target body second face (12) below the drive element (5). The tubular member (26) can have opposing tubular member external and internal surfaces (27)(28), whereby the tubular member internal surface (28) defines a substantially hollow tubular member passage (29) which communicates between opposing tubular member first and second ends (30)(31).

Now referring primarily to FIG. 3, as to particular embodiments, a drive element central axis (32) of the drive element (5) and a tubular member passage central axis (33) of the tubular member passage (29) can be substantially coincident.

Again referring primarily to FIG. 3, as to particular embodiments, the drive element (5) and the tubular member passage (29) can dispose along a target body longitudinal axis (34) of the target body (6).

The tubular member internal surface (28) can be configured to reciprocally telescopingly engage with the upper portion (3) of a support element (4) insertingly received within the tubular member passage (29). Accordingly, the tubular member internal surface (28) can define a tubular member passage (29) which can have any of numerous configurations of varying dimensions corresponding to the numerous configurations of varying dimensions of support elements (3) which can be insertingly received within the tubular member passage (29).

As to particular embodiments, the tubular member internal surface (28) can define a tubular member passage (29) having a substantially square cross section, as shown in the examples of the Figures. However, the invention need not be so limited, and as to other particular embodiments, the tubular member internal surface (28) can define a tubular member passage (29) having any of a numerous and wide variety of cross section configurations including or consisting of: a circle, an oval, a triangle, a square, a rectangle, a trapezoid, a polygon, a freeform shape, or the like, or combinations thereof.

Now referring primarily to FIG. 3, the tubular member (26) can have a tubular member length (35) disposed between the tubular member first and second ends (30)(31). Typically, the tubular member length (35) can be in a range of between about 1 inch to about 72 inches; however, particular embodiments can have lesser or greater tubular member lengths (35), depending upon the application. As to particular embodiments, the tubular member length (35) can be selected from the group including or consisting of: between about 1 inch to about 12 inches, between about 6 inches to about 18 inches, between about 12 inches to about 24 inches, between about 18 inches to about 30 inches, between about 24 inches to about 36 inches, between about 30 inches to about 42 inches, between about 36 inches to about 48 inches, between about 42 inches to about 54 inches, between about 48 inches to about 60 inches, between about 54 inches to about 66 inches, and between about 60 inches to about 72 inches.

Again referring primarily to FIG. 3, the tubular member (26) can have a tubular member width (36) disposed between tubular member first and second sides (37)(38). Typically, the tubular member width (36) can be in a range of between about ½ inch to about 72 inches; however, particular embodiments can have lesser or greater tubular member widths (36), depending upon the application. As to particular embodiments, the tubular member width (36) can be selected from the group including or consisting of: between about ½ inch to about 12 inches, between about 6 inches to about 18 inches, between about 12 inches to about 24 inches, between about 18 inches to about 30 inches, between about 24 inches to about 36 inches, between about 30 inches to about 42 inches, between about 36 inches to about 48 inches, between about 42 inches to about 54 inches, between about 48 inches to about 60 inches, between about 54 inches to about 66 inches, and between about 60 inches to about 72 inches.

As an illustrative example, the tubular member (26) can have a tubular member length (35) of about 18 inches and a tubular member width (36) of about 2.5 inches.

The tubular member (26) can be fixedly or removably coupled to the target body second face (12) by any of a wide variety of coupling materials including: welds, adherents, mechanical fasteners, cements, crimps, glues, seals, tapes, or the like, or combinations thereof. As an illustrative example, a tubular member (26) formed from metal can be fixedly coupled to a target body second face (12) formed from metal by welds (25) (as shown in the Figures by a stippled layer).

Now referring primarily to FIG. 3, FIG. 5, FIG. 6, and FIG. 8, as to particular embodiments, the drive element (5) can overlay the tubular member first end (30) to provide a closed-end tubular member (38). Accordingly, the upper portion (3) of the support element (4) can be insertingly received within the tubular member passage (29) by passing the upper portion (3) of the support element (4) through the open tubular member second end (31) and through the tubular member passage (29) until the upper portion (3) of the support element (4) abuttingly engages with the drive element second face (2) of the drive element (5).

Once the drive element (5) has impacted the upper portion (3) of the support element (4) to drive the lower portion (7) of the support element (4) a depth (8) into the support surface (9), whereby the depth (8) is sufficient to support the target assembly (1) in a desired position, the target body (6) can be coupled to the support element (4) by removably engaging the drive element (5) with the upper portion (3) of the support element (4), thereby supporting the target assembly (1) in a position suitable for use of the target assembly (1) as a shooting target.

As to particular embodiments further including a tubular member (26) coupled to the target body second surface (12) below the drive element (5), the target body (6) can be coupled to the support element (4) by inserting the upper portion (3) of the support element (4) into the tubular member passage (29) by passing the upper portion (3) of the support element (4) through the open tubular member second end (31) and additionally passing the upper portion (3) of the support element (4) from the tubular member second end (31) toward the tubular member first end (30) until the upper portion (3) of the support element (4) removably engages with the drive element (5). As to these particular embodiments, the tubular member (26) can function to align the support element (4) with the drive element (5) for removable abutting engagement. As to these particular embodiments, the tubular member (26) can further function to secure the removable engagement of the support element (4) with the drive element (5), particularly when a projectile force (40) is applied to the target body (6).

Now referring primarily to FIG. 9A through FIG. 9D, the tubular member internal surface (28) can be configured to allow the tubular member (26) and correspondingly, the target body (6) which is coupled to the tubular member (26), to rotate about a support element longitudinal axis (41) of the support element (4) when the upper portion (3) of the support element (4) is insertingly received within the tubular member passage (29).

Again referring primarily to FIG. 9A through FIG. 9D, the support element (4) can include a support element external surface (42) configured to allow the tubular member (26) and correspondingly, the target body (6) which is coupled to the tubular member (26), to rotate about the support element longitudinal axis (41) of the support element (4) when the upper portion (3) of the support element (4) is insertingly received within the tubular member passage (29).

As to particular embodiments, the support element external surface (42) can be configured to allow a limited amount of rotation of the tubular member (26) about the support element longitudinal axis (41) of the support element (4). In the examples of FIG. 9A through FIG. 9D, the support element (4) includes a pair of support element sides (43) joined in substantially perpendicular relation, whereby the dimensional relations defined by the pair of support element sides (43) are sufficiently less than the dimensional relations defined by the tubular member internal surface (28) of a tubular member (26) having a tubular member passage (29) with a substantially square cross section to allow the tubular member (26) to rotate about the support element longitudinal axis (41) of the support element (4).

As to particular embodiments of the target assembly (1) having a tubular member passage (29) with a substantially square cross section, the tubular member (26) can be a cuboidal tubular member (26) coupled to the target body (6) by welding of an edge of the cuboidal tubular member (26) to the target body (6). A projectile force (40) applied to the target body (6) can be sufficient to rotate the target body (6) coupled to the tubular member (26) about the support element longitudinal axis (41) of the support element (4). The rotation of the target body (6) about the support element longitudinal axis (41) can be impeded when the tubular member internal surface (28) rotates sufficiently to contact the support element external surface (42).

Figures 9A, 9B, 9C, 9D:
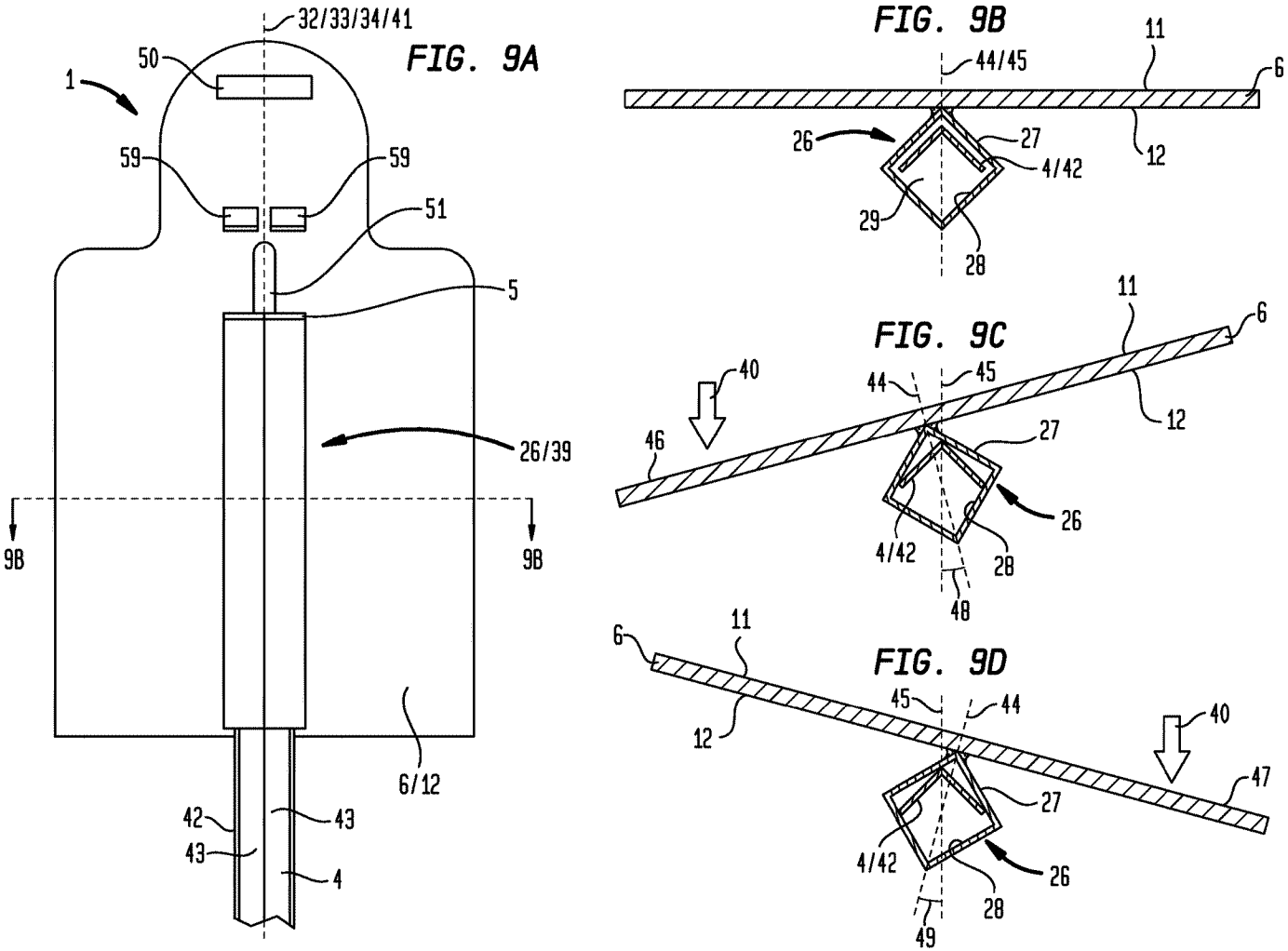
FIG. 9A is a second face view of a target body of a particular embodiment of a target assembly.
FIG. 9B is a cross sectional view 9B-9B of the particular embodiment of the target assembly shown in FIG. 9A in the absence of a projectile force.
FIG. 9C is a cross sectional view 9B-9B of the particular embodiment of the target assembly shown in FIG. 9A following application of a projectile force to a target body first side portion of a target body.
FIG. 9D is a cross sectional view 9B-9B of the particular embodiment of the target assembly shown in FIG. 9A following application of a projectile force to a target body second side portion of a target body.

As shown in the example of FIG. 9B, a target body (6) coupled to a tubular member (26) can be positioned at an angle of zero degrees in the absence of a projectile force (40), whereby the target body (6) can have a target body central latitudinal axis (44) in common with a support element central latitudinal axis (45). When a projectile force (40) is applied to target body first or second side portions (46)(47), the target body (6) can rotate about the support element longitudinal axis (41) in a direction corresponding with the applied projectile force (40) until further rotation is impeded by engagement of the tubular member internal surface (28) with the support element external surface (42) (as shown in the examples of FIG. 9C and FIG. 9D) (the "engaged condition").

In the engaged condition of FIG. 9C, whereby a projectile force (40) applied to the target body first side portion (46) urged rotation of the target body (6) in a counterclockwise direction about the support element longitudinal axis (41) to position the target body central latitudinal axis (44) in angled relation to the support element central latitudinal axis (45), the target body (6) can be positioned at a target body first angle (48) which is substantially less than zero degrees, for example an angle of −10 degrees.

In the engaged condition of FIG. 9D, whereby a projectile force (40) applied to the target body second side portion (47) urged rotation of the target body (6) in a clockwise direction about the support element longitudinal axis (41) to position the target body central latitudinal axis (44) in angled relation to the support element central latitudinal axis (45), the target body (6) can be positioned at a target body second angle (49) which is substantially greater than zero degrees, for example an angle of +10 degrees.

The target body first and second angles (48)(49) can be in a range of between about ±1 degree to about ±45 degrees. As to particular embodiments, the target body first and second angles (48)(49) can be selected from the group including or consisting of: between about ±1 degree to about ±1zero degrees, between about ±5 degrees to about ±15 degrees, between about ±1zero degrees to about ±2zero degrees, between about ±15 degrees to about ±25 degrees, between about ±2zero degrees to about ±3zero degrees, between about ±25 degrees to about ±35 degrees, between about ±3zero degrees to about ±4zero degrees, and between about ±35 degrees to about ±45 degrees.

Rotation of the target body (6) about the support element longitudinal axis (41) consequent to a projectile force (40) applied by a projectile (10) facilitates deflection of the projectile (10) away from a user (2) shooting the projectile (10) from a location remote from the target assembly (1).

For example, a projectile (10) may be deflected in a direction which is substantially toward the user (2) when the target body (6) is positioned at an angle of zero degrees (as shown in the example of FIG. 9B) following the application of the projectile force (40) by the projectile (10). In contrast, a projectile (10) may be deflected in a direction which is substantially away from the user (2) when the target body (6) is positioned at an angle of substantially less zero degrees (as shown in the example of FIG. 9C) or substantially greater than zero degrees (as shown in the example of FIG. 9D) following the application of the projectile force (40) by the projectile (10).

Now referring primarily to FIG. 2, FIG. 3, FIG. 5, FIG. 6, FIG. 8, and FIG. 10, as to particular embodiments, the target assembly (1) can, but need not necessarily, further include a handle element (50) coupled to the target body (6). While the illustrative example of the handle element (50) shown in the Figures depicts the handle element (50) coupled to the target body second face (12), the handle element (50) can additionally be coupled to the target body first face (11) or the target body periphery (13), depending upon the application. The handle element (50) can be formed from any of a numerous and wide variety of materials having any of a numerous and wide variety of configurations of varying dimensions which are suitable for grasping or transporting the target assembly (1).

Now referring primarily to FIG. 2, FIG. 3, FIG. 5, FIG. 6, FIG. 7, and FIG. 10, as to particular embodiments, the target assembly (1) can, but need not necessarily, further include one or more auxiliary target support members (51) coupled to the target body (6), whereby the auxiliary target support member (51) is configured to rotatably support an auxiliary target (52), particularly when a projectile force (40) is applied to the auxiliary target (52).

As to particular embodiments, the one or more auxiliary target support members (51) can be coupled to the target body second face (12), for example by any suitable method of joining materials, whether fixedly or removably, whereby the materials can include: welds, adherents, mechanical fastener, cements, crimps, glues, seals, tapes, or the like, or combinations thereof. As an illustrative example, an auxiliary target support member (51) formed from metal can be coupled to a target body second face (12) formed from metal by welds (25) (as shown in the Figures by a stippled layer).

Again referring primarily to FIG. 2, FIG. 3, FIG. 5, FIG. 6, FIG. 7, and FIG. 10, the one or more auxiliary target support members (51) can have any of a numerous and wide variety of configurations of varying dimensions sufficient to support, or as to particular embodiments rotatably support, an auxiliary target (52). As to particular embodiments, the auxiliary target support member (51) can include an auxiliary target support member aperture element (53) bounding an auxiliary target support member aperture element opening (54) configured to insertingly receive the auxiliary target (52).

As to particular embodiments, the auxiliary target support member aperture element (53) bounding the auxiliary target support member aperture element opening (54) can be disposed within an auxiliary target support member first end (55) of the auxiliary target support member (51). As to particular embodiments, the auxiliary target support member first end (55) can be an angled auxiliary target support member first end (55) which disposes in angled relation to the target body second face (12).

Figure 10:
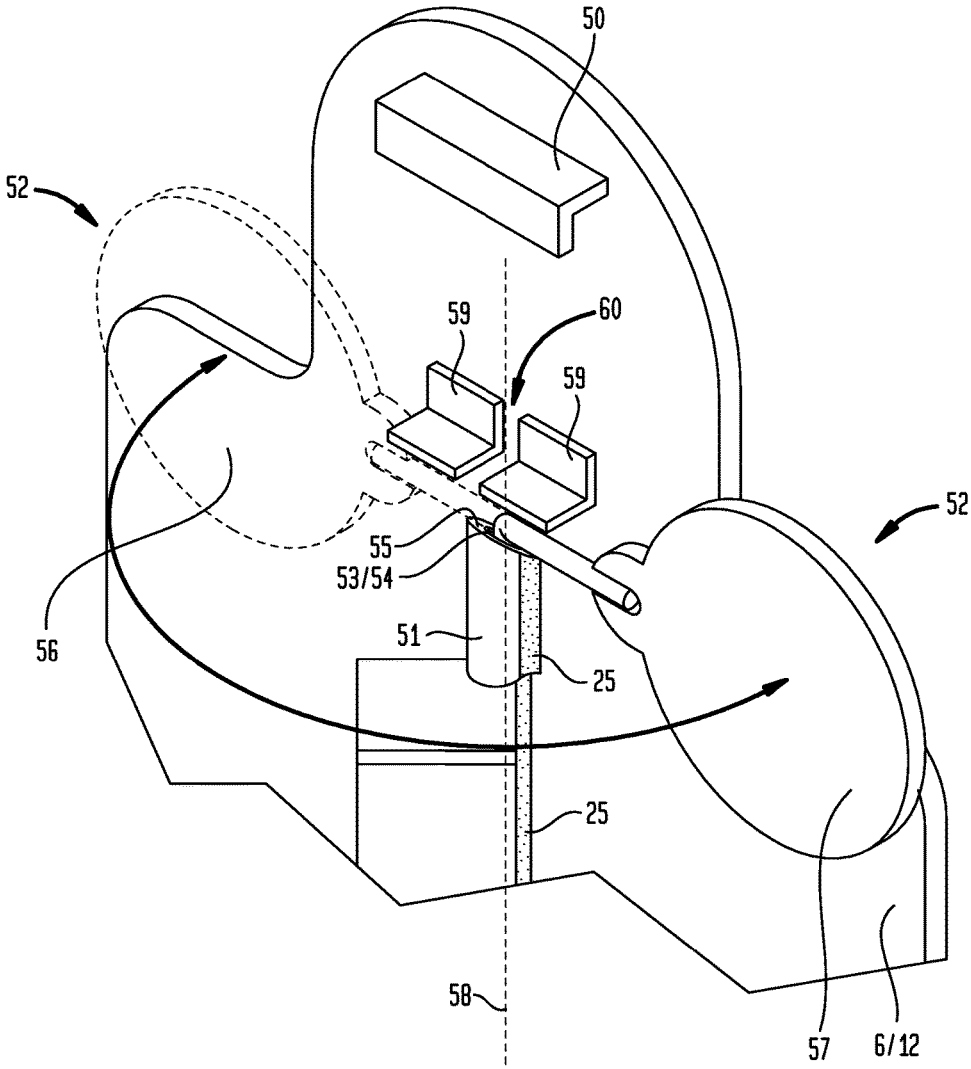
FIG. 10 is a perspective view of a target body of a particular embodiment of a target assembly.

Now referring primarily to FIG. 10, the angled auxiliary target support member first end (55) can function to urge an auxiliary target (52) insertingly received within the auxiliary target support member aperture element opening (54) and rotatably supported by the auxiliary target support member (51) toward the target body second face (12) in the absence of a projectile force (40). Accordingly, opposing auxiliary target first and second faces (56)(57) of the rotatably supported auxiliary target (52) can be disposed in substantially parallel relation to the target body second face (12) in the absence of a projectile force (40). As to particular embodiments, in the absence of a projectile force (40), the auxiliary target first face (56) can be disposed toward the target body second face (12) and the auxiliary target second face (57) can be disposed away from the target body second face (12) (as shown in the example of FIG. 10).

When a projectile (10) contacts the auxiliary target (52), a projectile force (40) is applied to the auxiliary target (52), rotating the auxiliary target (52) in a direction corresponding with the applied projectile force (40). In the example shown in FIG. 10, the projectile force (40) can be sufficient to rotate the auxiliary target (52) about an auxiliary target support member longitudinal axis (58). Following the application of the projectile force (40), the auxiliary target (52) can be rotated about 180 degrees, now disposing the auxiliary target second face (57) toward the target body second face (12) and the auxiliary target first face (56) away from the target body second face (12) (as shown in the example of FIG. 10 in broken line). When the projectile force (40) is not sufficient to rotate the auxiliary target (52) about 180 degrees, the angled auxiliary target support member first end (55) can function to urge the auxiliary target second face (57) toward the target body second face (12).

Now referring primarily to FIG. 2 and FIG. 10, as to particular embodiments, the target assembly (1) can, but need not necessarily, further include one or more auxiliary target stop elements (59) coupled to the target body second face (12) above the auxiliary target support member (51). The auxiliary target stop element (59) can be configured to stop upward movement of an auxiliary target (52) received within the auxiliary target support member aperture element opening (54) along the auxiliary target support member longitudinal axis (58), particularly when a projectile force (40) is applied to the auxiliary target (52).

As to particular embodiments, the one or more auxiliary target stop elements (59) can be coupled to the target body second face (12), for example by any suitable method of joining materials, whether fixedly or removably, whereby the materials can include: welds, adherents, mechanical fastener, cements, crimps, glues, seals, tapes, or the like, or combinations thereof. As an illustrative example, an auxiliary target stop element (59) formed from metal can be coupled to a target body second face (12) formed from metal by welds (25) (as shown in the Figures by a stippled layer).

Now referring primarily to FIG. 2 and FIG. 10, the auxiliary target stop element (59) can have any of a numerous and wide variety of configurations of varying dimensions sufficient to insertingly receive an auxiliary target (52) and stop upward movement of the auxiliary target (52) received within the auxiliary target support member aperture element opening (54) along the auxiliary target support member longitudinal axis (58). As to particular embodiments, the auxiliary target stop element (59) can be configured as two auxiliary target stop elements (59) positioned above the auxiliary target support member (51) and disposed on opposing side of the auxiliary target support member aperture element opening (54) such that a pass through (60) can be formed between the two auxiliary target stop elements (59). Accordingly, the auxiliary target (52) can pass through the pass through (60) for insertion into the auxiliary target support member aperture element opening (54).

Now referring primarily to FIG. 2, the support element (4) can include a support element length (61) disposed between the upper and lower portions (6)(7). Typically, the support element length (61) can be in a range of between about 6 inch to about 72 inches; however, particular embodiments can have lesser or greater support element lengths (61), depending upon the application. As to particular embodiments, the support element length (61) can be selected from the group including or consisting of: between about 6 inches to about 18 inches, between about 12 inches to about 24 inches, between about 18 inches to about 30 inches, between about 24 inches to about 36 inches, between about 30 inches to about 42 inches, between about 36 inches to about 48 inches, between about 42 inches to about 54 inches, between about 48 inches to about 60 inches, between about 54 inches to about 66 inches, and between about 60 inches to about 72 inches. As an illustrative example, the support element (4) can have a support element length (61) of about 60 inches.

Again referring primarily to FIG. 2, the support element (4) can include a support element width (62) disposed between the pair of support element sides (43). Typically, the support element width (62) can be in a range of between about 1 inch to about 12 inches; however, particular embodiments can have lesser or greater support element widths (62), depending upon the application. As to particular embodiments, the support element width (62) can be selected from the group including or consisting of: between about 1 inch to about 3 inches, between about 2 inches to about 4 inches, between about 3 inches to about 5 inches, between about 4 inches to about 6 inches, between about 5 inches to about 7 inches, between about 6 inches to about 8 inches, between about 7 inches to about 9 inches, between about 8 inches to about 10 inches, between about 9 inches to about 11 inches, and between about 10 inches to about 12 inches. As an illustrative example, the support element (4) can have a support element width (62) of about 2.5 inches.

Now referring primarily to FIG. 2 and FIG. 9A, the support element (4) can have a support element external surface (42) which can define numerous configurations of varying dimensions. While the illustrative example of the support element external surface (42) shown in the Figures defines a three-dimensional substantially V-shaped configuration, particular embodiments can have a support element external surface (42) which defines any suitable configuration, including or consisting of: a cylinder, a cuboid, a polyhedral, or the like, or combinations thereof.

Now referring primarily to FIG. 2, as to particular embodiments, one or more auxiliary target support members (51) can, but need not necessarily, be coupled to the support element (4).

A method of making a target assembly (1) can include providing a target body (6), and coupling a drive element (5) to the target body (6), whereby the drive element (5) can be configured for impacting an upper portion (3) of a support element (4) to impactingly drive a lower portion (7) of the support element (4) into a support surface (9).

As to particular embodiments, the method of making the target assembly (1) can, but need not necessarily, further include configuring the target body (6) to have opposing target body first and second faces (11)(12), and can, but need not necessarily, further include outwardly extending the drive element (5) from the target body second face (12).

As to particular embodiments, the method of making the target assembly (1) can, but need not necessarily, further include configuring the drive element (5) to have opposing drive element first and second faces (21)(22), and can, but need not necessarily, further include disposing the drive element second face (22) in angled relation to the target body second face (12). As to particular embodiments, the angled relation can include a drive element second face angle (23) in a range of between about 60 degrees to about 120 degrees.

As to particular embodiments, the method of making the target assembly (1) can, but need not necessarily, further include coupling a tubular member (26) to the target body second face (12) below the drive element (5). As to particular embodiments, the method of making the target assembly (1) can, but need not necessarily, further include configuring the tubular member (26) to have opposing tubular member external and internal surfaces (27)(28), whereby the tubular member internal surface (28) defines a tubular member passage (29) which communicates between opposing tubular member first and second ends (30)(31). As to particular embodiments, the method of making the target assembly (1) can, but need not necessarily, further include disposing a drive element central axis (32) of the drive element (5) and a tubular member passage central axis (33) of the tubular member passage (29) in substantially coincident relation. As to particular embodiments, the method of making the target assembly (1) can, but need not necessarily, further include disposing the drive element (5) and the tubular member passage (29) along a target body longitudinal axis (34) of the target body (6).

As to particular embodiments, the method of making the target assembly (1) can, but need not necessarily, further include overlaying the drive element (5) over the tubular member first end (30) to provide a closed-end tubular member (39).

As to particular embodiments, the method of making the target assembly (1) can, but need not necessarily, further include configuring the tubular member internal surface (28) to allow the tubular member (26) and correspondingly, the target body (6) which is coupled to the tubular member (26), to rotate about a support element longitudinal axis (41) of the support element (4) when the upper portion (3) of the support element (4) is insertingly received within the tubular member passage (29).

As to particular embodiments, the method of making the target assembly (1) can, but need not necessarily, further include configuring a support element external surface (42) of the support element (4) to allow the tubular member (26) and correspondingly, the target body (6) which is coupled to the tubular member (26), to rotate about the support element longitudinal axis (41) of the support element (4) when the upper portion (3) of the support element (4) is insertingly received within the tubular member passage (29). As to particular embodiments, rotation of the target body (6) about the support element longitudinal axis (41) consequent to a projectile force (40) applied by a projectile (10) can facilitates deflection of the projectile (10) away from a user (2) shooting the projectile (10) from a location remote from the target assembly (1).

As to particular embodiments, the method of making the target assembly (1) can, but need not necessarily, further include coupling a handle element (50) to the target body (6).

As to particular embodiments, the method of making the target assembly (1) can, but need not necessarily, further include coupling one or more auxiliary target support members (51) to the target body (6), whereby the auxiliary target support member (51) can be configured to rotatably support an auxiliary target (52). As to particular embodiments, the method of making the target assembly (1) can, but need not necessarily, further include disposing an auxiliary target support member aperture element (53) within the auxiliary target support member (51), the auxiliary target support member aperture element (53) bounding an auxiliary target support member aperture element opening (54) configured to insertingly receive the auxiliary target (52). As to particular embodiments, the method of making the target assembly (1) can, but need not necessarily, further include disposing the auxiliary target support member aperture element (53) bounding the auxiliary target support member aperture element opening (54) within an angled auxiliary target support member first end (55) which disposes in angled relation to the target body second surface (12).

As to particular embodiments, the method of making the target assembly (1) can, but need not necessarily, further include coupling one or more auxiliary target stop elements (59) to the target body second face (12) above the auxiliary target support member (51), the auxiliary target stop element (59) configured to stop upward movement of the auxiliary target (52) received within the auxiliary target support member aperture element opening (54) along an auxiliary target support member longitudinal axis (58).

As to particular embodiments, the method of making the target assembly (1) can, but need not necessarily, further include coupling one or more auxiliary target support members (51) to the support element (4), the auxiliary target support member (51) configured to rotatably support an auxiliary target (52).

Particular components of the target assembly (1), including the support element (4), the drive element (5), the target body (6), the tubular member (26), the handle element (50), the auxiliary target support member (15), the auxiliary target (52), or the auxiliary target stop element (59), can be produced from any of a wide variety of processes depending upon the application, such as press molding, injection molding, fabrication, machining, printing, additive printing, or the like, or combinations thereof, as one piece or assembled from a plurality of pieces into an embodiment of the target assembly (1).

A method of using a target assembly (1) can include obtaining the target assembly (1) having a target body (6) and a drive element (5) coupled to the target body (6), whereby the drive element (5) can be configured for impacting an upper portion (3) of a support element (4) to impactingly drive a lower portion (7) of the support element (4) into a support surface (9); and engaging the upper portion (3) of the support element (4) with the drive element (5) to impactingly drive the lower portion (7) of the support element (4) a depth (8) into the support surface (9).

As to particular embodiments, the method of using the target assembly (1) can, but need not necessarily, further include removably engaging the target body (6) with the upper portion (3) of the support element (4) to provide a shooting target.

As can be easily understood from the foregoing, the basic concepts of the present invention may be embodied in a variety of ways. The invention involves numerous and varied embodiments of a target assembly and methods for making and using such target assemblies, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "mount" should be understood to encompass disclosure of the act of "mounting"—whether explicitly discussed or not—and, conversely, were there effectively disclosure of the act of "mounting", such a disclosure should be understood to encompass disclosure of a "mount" and even a "means for mounting." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" substantially refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the target assemblies herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A target assembly comprising:

a target body comprising opposing target body first and second faces;

a drive element directly coupled to said target body second face to outwardly extend therefrom, said drive element configured for impacting an upper portion of a support element to impactingly drive a lower portion of said support element into a support surface;

a tubular member directly coupled to said target body second face below said drive element, said tubular member comprising a tubular member passage which communicates between opposing tubular member first and second ends;

wherein said drive element overlays said tubular member first end and correspondingly, said tubular member passage, to provide a closed-end tubular member.

2. The target assembly of claim 1, wherein said drive element comprises opposing drive element first and second faces, and wherein outward extension of said drive element from said target body second face disposes said drive element second face in angled relation to said target body second face.

3. The target assembly of claim 2, wherein said angled relation comprises a drive element second face angle in a range of between about 60 degrees to about 120 degrees.

4. The target assembly of claim 1, wherein said tubular member comprises opposing tubular member external and internal surfaces, and wherein said tubular member internal surface defines said tubular member passage which communicates between said opposing tubular member first and second ends.

5. The target assembly of claim 4, wherein a drive element central axis of said drive element and a tubular member passage central axis of said tubular member passage are substantially coincident.

6. The target assembly of claim 5, wherein said drive element and said tubular member passage dispose along a target body longitudinal axis of said target body.

7. The target assembly of claim 4, wherein said tubular member internal surface is configured to allow said tubular member and correspondingly, said target body which is coupled to said tubular member, to rotate about a support element longitudinal axis of said support element when said upper portion of said support element is insertingly received within said tubular member passage.

8. The target assembly of claim 7, wherein said support element comprises a support element external surface configured to allow said tubular member and correspondingly, said target body which is coupled to said tubular member, to rotate about said support element longitudinal axis of said support element when said upper portion of said support element is insertingly received within said tubular member passage.

9. The target assembly of claim 8, wherein rotation of said target body about said support element longitudinal axis consequent to a projectile force applied by a projectile facilitates deflection of said projectile away from a user shooting said projectile from a location remote from said target assembly.

10. The target assembly of claim 9, further comprising a handle element coupled to said target body.

11. The target assembly of claim 9, further comprising one or more auxiliary target support members coupled to said target body, said auxiliary target support member configured to rotatably support an auxiliary target.

12. The target assembly of claim 11, wherein said auxiliary target support member comprises an auxiliary target support member aperture element bounding an auxiliary target support member aperture element opening configured to insertingly receive said auxiliary target.

13. The target assembly of claim 12, wherein auxiliary target support member aperture element bounding said auxiliary target support member aperture element opening is disposed within an angled auxiliary target support member first end which disposes in angled relation to said target body second surface.

14. The target assembly of claim 12, further comprising one or more auxiliary target stop elements coupled to said target body second face above said auxiliary target support member, said auxiliary target stop element configured to stop upward movement of said auxiliary target received within said auxiliary target support member aperture element opening along an auxiliary target support member longitudinal axis.

15. The target assembly of claim 9, further comprising one or more auxiliary target support members coupled to said support element, said auxiliary target support member configured to rotatably support an auxiliary target.

* * * * *